United States Patent [19]

Miyamoto et al.

[11] 4,057,339

[45] Nov. 8, 1977

[54] ELECTROSTATIC LATENT IMAGE TRANSFER TYPE COPYING APPARATUS

[75] Inventors: Osamu Miyamoto, Toyokawa; Isao Iizaka, Shinshiro; Toshio Yamamoto, Toyokawa; Takashi Hikosaka, Aichi; Shigemitu Shimizu, Toyokawa, all of Japan

[73] Assignee: Minolta Camera Kabushiki Kaisha, Osaka, Japan

[21] Appl. No.: 643,957

[22] Filed: Dec. 23, 1975

[30] Foreign Application Priority Data

| | | |
|---|---|---|
| Jan. 7, 1975 | Japan | 50-4717 |
| Jan. 13, 1975 | Japan | 50-6835 |
| Jan. 10, 1975 | Japan | 50-6620[U] |

[51] Int. Cl.[2] ..... G03G 15/00

[52] U.S. Cl. ..... 355/3 R; 96/1 TE

[58] Field of Search ..... 355/3 R, 3 TR, 3 TE; 96/1 R, 1 TE

[56] References Cited

U.S. PATENT DOCUMENTS

| | | | |
|---|---|---|---|
| 3,817,615 | 6/1974 | Adachi et al. | 355/3 TE |
| 3,879,120 | 4/1975 | Kurokawa et al. | 355/3 TE |
| 3,879,121 | 4/1975 | Simpson | 355/3 TR |
| 3,950,680 | 4/1976 | Michaels et al. | 317/262 A |

*Primary Examiner*—L. T. Hix
*Assistant Examiner*—J. A. LaBarre
*Attorney, Agent, or Firm*—Wenderoth, Lind & Ponack

[57] ABSTRACT

Apparatus for improving the quality of images obtained in an electrostatic latent image transfer type copier according to which there are provided electrical circuits permitting escape or neutralization of charges which may be produced in copy paper during its transport through a photocopying machine and could cause smudging or elimination of required image portions in developed copy paper carrying the image of a document or similar material.

In the disclosed embodiment, the electrical circuits maintain each of the rollers of pairs of copy sheet transporting rollers at an equal potential.

20 Claims, 11 Drawing Figures

ELECTROSTATIC LATENT IMAGE TRANSFER TYPE COPYING APPARATUS

The present invention relates to means for prevention of occurrence of undesired electrostatic charge or electrostatic soiling liable to result in smudging or blanks in copying paper to obtain images of improved quality thereon in an electrostatic latent image transfer type copying machine.

Recently, in the field of electrophotocopying methods and copying machines, according to a method which has come into common use an electrostatic latent image carrying the content of a document or other information of which it is desired to obtain a copy is formed on the surface of a photosensitive material and is then transferred onto a sheet of copy paper comprising a rear layer of conductive material, normally having a resistance of $10^5$ to $10^9$ Ω, and an outer surface layer of dielectric material, normally having a resistance of at least $10^{11}$ Ω, the electrostatic latent image on the copy paper subsequently being developed to produce a visible image.

This method has various advantages over conventional methods. For example, compared to powder image transfer type methods the required photocopying apparatus is simpler in construction and is easier to operate and maintain, while compared to the so-called electrofacsimile method the image quality obtained is much higher. A further advantage is that copy paper employed may be easily manufactured since it has a construction closely resembling that of ordinary paper. On the other hand, there is specifically associated with the electrostatic image photocopying method a problem, which is that since an image developed on a sheet of copy paper is defined by electrostatic charges produced in the paper during the preceding photocopy processes, in order to obtain an image which carries only the content of a document required to be copied it is necessary to avoid production of electrical charge in portions of the paper other than the portions thereof required to carry an image. In practical applications of the electrostatic photocopying method hitherto it has not been possible to avoid production of such undesired charge. Although such undesired charge in the electrostatic photocopying machine is produced as a result of various phenomena, it is to be noted that the most noticable smudging in copy paper is the result of a phenomenon of charge and discharge. In general, this charge and discharge phenomenon is often generated when the copy paper has applied thereto pressure or friction by means of an external member, and, then, is loaded with a charge having a polarity opposite to that of a transferred electrostatic image during electrostatic photocopying in the copying machine. For example, transfer of copy paper through a photocopying machine is most suitably effected by roll means. Such roll means apply on the copy paper pressure which, due to the piezoelectric effects which may occur in dielectric material, results in production of a charge in the dielectric layer of the copy paper. Furthermore this pressure, and hence charge, is not distributed evenly throughout the copy paper, but is applied for a comparatively short time on portions of sheets of copy paper actually passing through the roll means during production of copies of documents, and for a longer time on end portions of sheets of copy paper which are held between the roll means between actual production of photocopies.

Charge not corresponding to a portion of an image of a document is also produced in the copy paper due to friction between the roll means and the copy paper passing therethrough. This friction is produced on portions of the sheets of copy paper which are strongly rubbed by the roll means, resulting in the production of undesired charge on the rubbed portions of the copy paper. In subsequent development of an electrostatic image transferred onto a sheet of copy paper, portions of the copy paper carrying such undesired charge resulting from pressure or friction are developed, thereby resulting in smudging or obscuring of portions of the image carried by the copy paper or in a general lowering of the whiteness of the background against which this image is viewed, with consequent reduction of the quality of the copied image on the copy paper.

Another problem in electrostatic photocopying methods is the following. The process of transfer of an electrostatic image from a photosensitive medium to a sheet of copy paper is generally, and most conveniently, effected by providing the photosensitive medium on the outer surface of a rotatory drum and, while the drum is rotated, moving the sheet of copy paper into contact with and past a peripheral portion of the drum, referred to below as the 'transfer point', the sheet of copy paper being pressed into contact with the drum by a conductive rotatory means which is grounded or to which a bias voltage is applied, successive portions of an image being transferred onto successive portions of the sheet of copy paper passing the transfer point. When this manner of image transfer is employed, it is necessary to provide press means to bring the copy paper into contact with the drum shortly before the actual transfer point, in order to avoid too sudden an application of charge on the copy paper portions coming to the transfer point, this press means of course contacting the conductive backing layer of the copy paper. However, during movement of the copy paper through a copying machine to the transfer point the front face dielectric layer thereof is contacted by conductive elements, such as cutters for cutting successive sheets of copy paper from a continuous roll, for example, and the size of a sheet of copy paper is generally such that when a front end portion thereof is at or near the transfer point the dielectric layer of a rear end portion thereof is still contacted by such conductive elements in the copying machine. Thus, since a relatively large charge is produced in the conductive layer of the copy paper upon contact of the copy paper with an image-carrying portion of the photosensitive drum, when the copy paper is first brought into contact with the photosensitive drum and a rear portion thereof is still contacted by conductive elements in the copying machine, the dielectric layer of the copy paper is subjected to a load having a polarity opposite to that of a transferred electrostatic image, with the result that certain portions of the copy paper which should be black upon development remain white, and there are blanks in the copy, and there may be smudging of the copied image.

Hitherto production of such undesired charges in the copy paper during transport thereof through a photocopying machine has been unavoidable, thereby lessening to some extent the advantages presented by the electrostatic photocopying method.

It is accordingly a principal object of the present invention to provide a means for improvement of the quality of images obtained in an electrostatic photocopying machine, by elimination of the disadvantages inherent in the conventional photocopying machine.

It is another object of the invention to provide a means which permits improvement of the quality of photocopies produced in an electrostatic photocopying machine, and prevents undesired electrostatic charge from being produced from the charge and discharge phenomenon, which is liable to result in smudging or blanks in the copying paper in the copying machine, by the employment only of simple means.

It is a further object of the invention to provide an apparatus for prevention of occurrence of smudging or blanks in copying paper employed in a copying machine.

In order to accomplish these and other objects the inventors carried out research into various aspects of the electrostatic photocopying process in a practical copying machine, particular attention being paid to locations at which undesired electrostatic charge or electrostatic soiling may be produced in the copy paper. It was found that by suitable selection of materials employed in the manufacture of means for forwarding copy paper through a copying machine and by the provision, at suitable points along the path over which copy paper is moved to a transfer point, of simple circuits permitting escape or equalization of charges which may be produced in copy paper, it is possible to eliminate charges other than those constituting the electrostatic image of a document to be copied. Also according to the invention there may be provided simple guide means which prevent undesired contact of copy paper with conductive elements in a copying machine.

Further objects and advantages of the present invention will become more apparent from the following description of the invention when considered in conjunction with the accompanying drawings forming a part thereof, in which.

Figure 4:
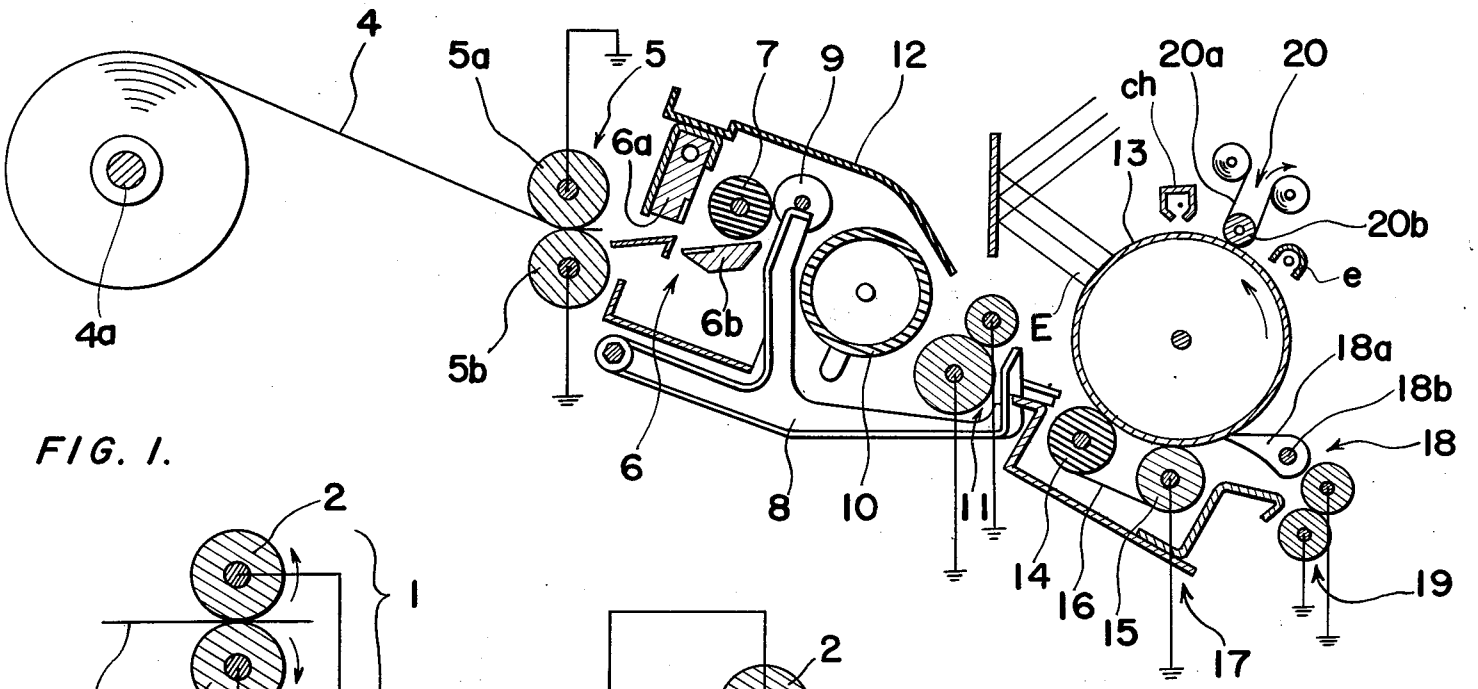
FIG. 4 is a schematic drawing of an electrostatic photocopying machine including smudging and blank prevention means according to the invention.
Figure 4A:
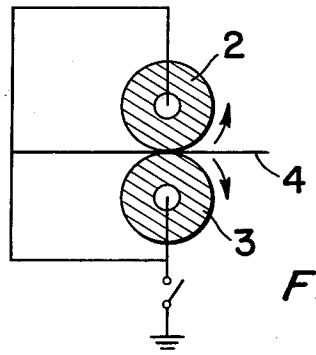
Figure 5:
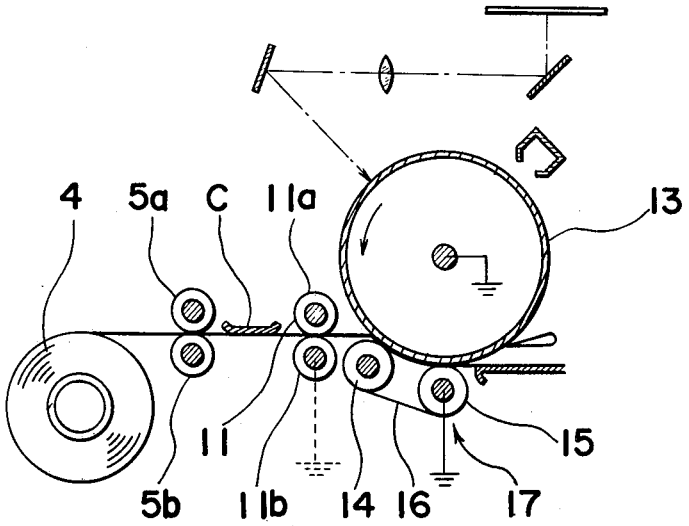
Figure 6:
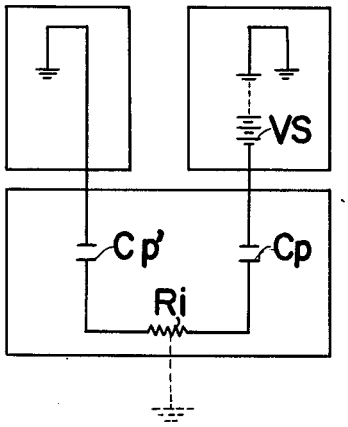
Figure 7:
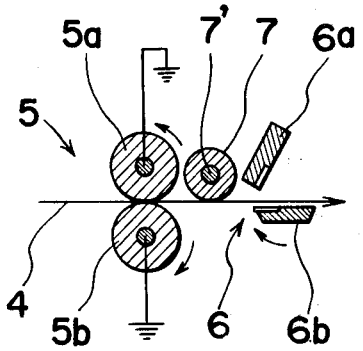
Figure 7:
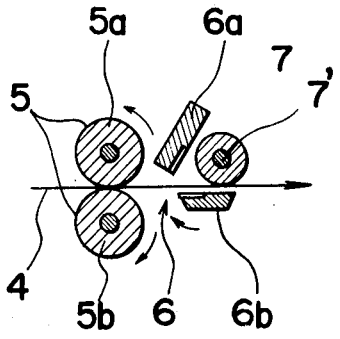
Figure 7:
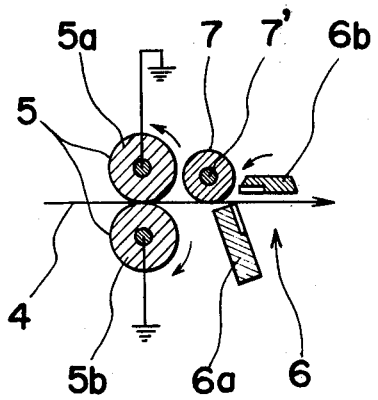
Figure 7:
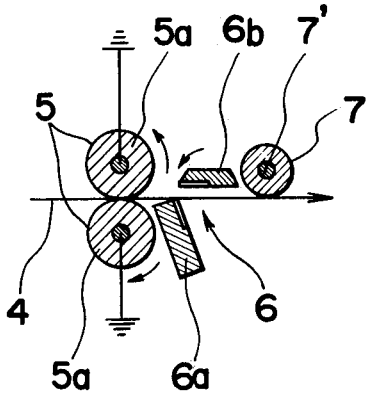

FIG. 4*a* is a partial schematic view of a part of the machine of FIG. 4;

FIG. 5 is a schematic view of smudging and blank prevention means according to the invention;

FIG. 6 is a circuit illustrating principles of blank prevention according to the invention; and FIGS. 7(*a*) through 7(*d*) are schematic views showing alternative positions of a copy paper guide means.

Before the description of the present invention proceeds, it is to be noted that like parts are designated by like reference numerals throughout several views of the attached drawings.

Figure 1:
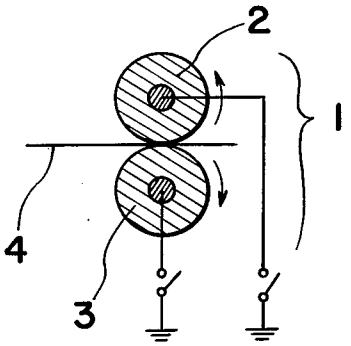
FIG. 1 is a schematic longitudinal section of equipment employed in tests carried out by the inventors.

Referring to FIG. 1, there is shown schematically equipment which was employed in experiments and research relating to development of the invention, and which comprises a pair of rolls 1 including a first roll 2 and a second roll 3 which are both selectively connectable to ground, which are urged towards one another by a pressure means (not shown) at a contact pressure in the range of 300 – 500 g, and which when rotated, by suitable drive means not shown, in the directions indicated by the arrows in the drawing, forward copy paper 4 inserted therebetween.

Results of the experiments are shown in Table 1(*a*) and Table 1(*b*) below, in which a cross X indicates the occurrence of electrostatic smudging on developed copy paper, i.e., production on the copy paper 4 upon development thereof of visible image portions not corresponding to the content of a document the image of which has been transferred onto the copy paper, and a circle O indicates absence of smudging. The circle O substantially shows the cases of non-existence of electrostatic smudges in the copy paper, that is, the cases in which the light absorption in a reflection test for indicating electrostatic smudges in visible image portions of the copy paper developed by a wet method is below 0.11, or the cases in which the voltage level in smudged portions of the copy paper is below 1 volt. In addition, the circle O represents the cases in which the copy paper can be employed in practical use without trouble in spite of existence of blanks therein after developing of the copy paper electrified by pressure or friction with a polarity relative to that of toner to be applied in the development. On the contrary, the cross X shows the cases of the existence of electrostatic smudges in the copy paper, that is the cases in which the concentration in a reflection test for indicating electrostatic smudges in visible image portions of the copy paper developed by a wet method is above 0.11 and the voltage level in smudged portions of the copy paper is above 1 volt. The term "YES" in the row headed "Blanks" indicates the occurrence of white blanks on the copying paper which is caused by the injection of charges having the same polarity as that of the toner into the copying paper. Where there is no occurrence of such blanks, the row is left empty. Table 1(*a*) shows the results after at least a portion of copy paper has remained stationary between the pair of rolls 1 for three minutes, and Table 1(*b*) the results after copy paper has remained stationary between the pair of rolls 1 for three seconds. Two types of copy paper were employed in the experiments, one type, indicated as Paper A in the tables, having a dielectric layer constituted mainly by polyvinyl butyl, and the other type, indicated as Paper B in the tables, having a dielectric layer constituted mainly by a copolymer of methyl methacrylate and styrene.

The materials employed for the rolls as indicated in Table 1(*a*) and Table 1(*b*) were as follows. The metal employed was chrome-plated iron, the conductive resin was polyurethane foam having a polyester coating with carbon admixed therein to impart conductivity thereto (resistance 100 Ω), the conductive rubber was nitrile-butadiene rubber (resistance $10^4$ Ω, rubber degree of hardness 45°–50°) having additives such as carbon, the dielectric resin was acetal copolymer such as Duracon (trade name of polyacetal resin product of Polyplastics Co., Ltd. of Japan), and the dielectric rubber was nitrile-butadiene rubber (resistance over $10^{12}$ Ω, degree of hardness 45°), and when a conductive material was used for a roll the roll was grounded.

Table 1

(a)

Table 1-continued

| First Roll Material | Second Roll Material | Paper A | Blanks | Paper B | Voltage Level of Smudged Paper |
|---|---|---|---|---|---|
| metal | conductive resin | 0 | | 0 | (light absorption) |
| metal | conductive rubber | 0 | | 0 | |
| metal | metal | 0 | | 0 | |
| metal | dielectric rubber | 0 | | X | 11.0 V(0.26) |
| conductive resin | conductive resin | 0 | | 0 | |
| conductive resin | conductive rubber | 0 | | 0 | |
| conductive resin | dielectric rubber | 0 | | X | 5.2 V(0.16) |
| dielectric resin | metal | X | YES | X | 5.2 V(0.16) |
| dielectric resin | conductive resin | X | | X | 5.2 V(0.16) |
| dielectric resin | dielectric rubber | 0 | YES | X | 2.4 V(0.13) |

(b)

| First Roll Material | Second Roll Material | Paper A | Blanks | Paper B | Voltage Level of Smudged Paper |
|---|---|---|---|---|---|
| metal | conductive resin | 0 | | 0 | (light absorption) |
| metal | conductive rubber | 0 | | 0 | |
| metal | metal | 0 | | 0 | |
| metal | dielectric rubber | 0 | | X | 3.6 V(0.14) |
| conductive resin | conductive resin | 0 | | 0 | |
| conductive resin | conductive rubber | 0 | | 0 | |
| conductive resin | dielectric rubber | 0 | | X | 1.6 V(0.12) |
| dielectric resin | metal | 0 | | X | 1.6 V(0.12) |
| dielectric resin | conductive resin | 0 | | X | 1.6 V(0.12) |
| dielectric resin | dielectric rubber | 0 | | 0 | |

After analyzing the results of Table 1(*a*) and Table 1(*b*), it is seen that the reason the copy paper A for which all the circles O occur, when it remains stationary between the rolls 2 and 3 for only three seconds or three minutes, has the concentration of below 0.11 when subjected to the reflection test is that the paper A is constituted by a dielectric layer of polyvinyl butyral which has a pressure sensitivity lower than that of the paper B constituted by a dielectric layer comprising a copolymerizate of methacrylic acid methyl and styrene. If the dielectric layer of copy paper A is constituted by a resin having a higher pressure sensitivity, it is easy to cause the occurence of the blanks or the smudges in portions of the copy paper electrified by pressure due to the employment of the special combination of both rolls 2 and 3. According to each combination of the first and second rolls 2 and 3 listed in Table 1 and 2, there is a distinct difference between the extent of occurrence of electrostatic smudges in the copy paper each corresponding to the one of the above combinations, as described hereinafter. At first, with a combination in which the first roll is a metal roll and the second roll is a dielectric rubber roll, the copy paper B is passed therebetween according to the above process, and a charge of 11 volts measured by a surface voltmeter is produced at the pressed portions thereof, and, then, it is developed by a wet method to obtain a visible image thereon, the concentration of which as determined by the reflection test is determined to be 0.26. If a copy paper having lower pressure sensitivity is employed with the above combination, a voltage of 1 volt is produced at the pressed portions thereof and the concentration is below 0.11 as determined by the reflection test and there are no significant blanks thereon. Also, if dielectric material such as dielectric resin, dielectric rubber and the like is employed for at least one of the first and second rolls, except for the combination of a dielectric resin roll and a dielectric rubber roll and the paper remaining stationary between the rolls only for three seconds, distinct electrostatic smudges are always produced in the paper B, while visible white blanks which cause no problem during use are produced in the paper A which remains for only for three seconds between a dielectric resin roll and a metal roll. Accordingly, it is seen that, with the employment of dielectric material for one or both of the first and second rolls, the surface of the copy paper is electrified by pressure or friction of the rolls, thereby or cause to produce blanks or smudging of the copy paper.

In addition, although with the paper A of Table 1(*a*) and Table 1(*b*) when the rolls are constituted by dielectric material, there is substantially no blanks or smudging on the paper A processed by the rolls. This is because the conductive layer of the paper A has low pressure sensitivity. But, if the rolls are used repeatedly so as to store one charge after another in the rolls themselves, blanks or smudging of the paper A gradually begin to occur in proportion to the number times the rolls are used.

Figure 2:
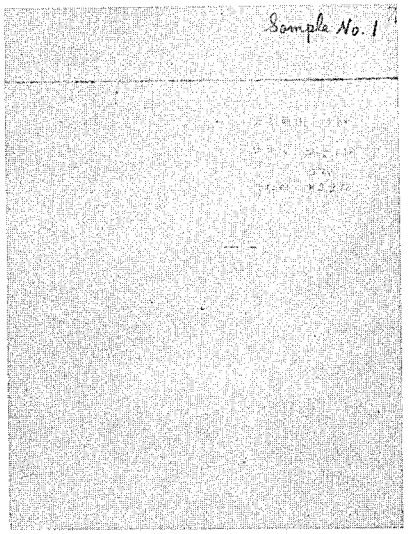
FIG. 2 is a photograph showing a portion of copy paper having a dielectric layer constituted mainly by a copolymer of methyl methacrylate and styrene after passing between a dielectric plastic roll and a dielectric rubber roll.
Figure 3:
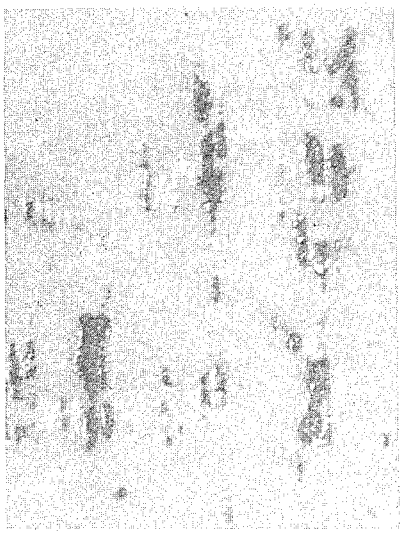
FIG. 3 is a microphotograph at a magnification of 115 showing a portion having a strip of blank in the copy paper of FIG. 3.

Relating to the smudging of the copy paper as described above, there are shown FIGS. 2 and 3 phenomenon due to charging of the copy paper with a charge having the opposite polarity from that of the toner by means of the roll pressure. FIG. 2 is a photograph of copy paper B developed by the wet method after remaining stationary for one hour between a dielectric resin roll and a dielectric rubber roll as set forth in Table 1, in which stripes of black smudging clearly correspond to portions of the paper which have been pressed by the rolls. FIG. 3 is a photograph of a smudged portion of FIG. 2 on an enlarged scale with a magnification of 115. From these photographs, it can be seen that particular attention must be given to the image smudging of paper due to application of pressing and frictional charges to the paper by the dielectric roll.

On the other hand, where both of the rolls are constituted by conductive material instead of dielectric material, good results can be obtained without image smudging on any paper as shown from the experimental results in Table 1. This is because of the conductivity in both rolls and the short-circuiting or grounding of both rolls, i.e., the condition of closing of both contacts of FIG. 1, and there is no occurrence of the above described smudging of the paper due to neutralization of electrostatic charge generated on the paper by the pressing charge from the rolls. This result is for the reason that, if the copy paper of FIG. 1 is looked at as a condenser and both the rolls are grounded, both rolls can be held at the same voltage according to the principal of discharging of a condenser for preventing the production of the above-described electrostatic smudging on the paper due to neutralizing the electrostatic charge generated on the paper. However, it is to be noted that if both of the rolls are constituted by metal, there is considerable trouble in practical use, such as difficulty in the transportation of the paper due to slippage of the paper between the rolls or damage to the paper due the pressure of rolls on a part of paper, and the concept of the present invention is not effective to overcome the problems to the same extent as the non-metallic rolls even if a combination of the rolls has obtained good results in the experiments producing the results shown in Table 1.

Therefore, as seen from the foregoing, in spite of the results of Table 1(*a*) and Table 1(*b*) when metal is used for both rolls 2 and 3 there is smudging of copy paper caused by friction by the rolls on the copy paper during their rotation for transport thereof as these rolls tend to cause slippage of the copying paper. This friction causes the injection of charges into the copying paper which as the result will have some electrostatic potential thereon. Also, although the use of dielectric material for one or both of the rolls 2 and 3 does not result in smudging of the copy paper as shown by the circles O when the copy paper remains stationary between the rolls 2 and 3 for only three seconds, use of dielectric material for either roll 2 or roll 3 results in smudging of copy paper as shown by the crosses X when copy paper remains stationary between the rolls 2 and 3 for three minutes. According to the invention when rolls such as rolls 2 and 3 are employed as copy paper forwarding rolls in an electrostatic photocopying machine both rolls are made of conductive material and at least one of the rolls is made of comparatively soft, resilient material, both rolls being electrically grounded. The same results may of course be obtained by providing an electrical short circuit between the rolls.

By the employment of resilient material for one roll, the contact area between the roll and paper are so much increased sufficiently without unbalance of the roll pressure to reduce the pressure charge produced by the roll on a part of the paper, and the paper is positively transported by the rolls.

Reference is now had to FIG. 4 which shows an electrostatic photocopying machine wherein production of undesired or electrostatic soiling in copy paper which are liable to cause smudging or blanks in developed photocopies is prevented according to the invention. Copy paper 4, wound in a large roll around a small rotatable roll means 4*a* made of dielectric material, is drawn from the large roll by forwarding rolls 5*a* and 5*b*, which correspond to the forwarding rolls 2 and 3 described above, and which for each copy produced are actuated to draw out and forward a length of copy paper 4 equal to one sheet length. Rolls 5*a* and 5*b* are grounded. Alternatively they may be short circuited as shown in FIG. 4*a*. Simultaneously with termination of the action of the forwarding rolls 5*a* movable cutter 6*b* is actuated and in cooperation with a fixed cutter 6*a* cuts the copy paper 4, which in this embodiment is prevented by an idle roller or insulating guide roller 7 from riding up unnecessarily against the fixed cutter 6*a*. The copy paper 4 is moved past an actuator 8 which detects the arrival of the leading edge and the rear edge of a sheet of copy paper 4 and causes necessary actuation of other machine elements depending on the position of the sheet of copy paper in the photocopying machine. While contacting the actuator 8 the copy paper 4 is prevented from moving away from a required line of travel by a guide roller 9 made of dielectric material. The copy paper 4 passes along the inner side of a guide wall 12 made of dielectric material and is moved around a loop guide 10 having a movable center of rotation and then brought into engagement with the guide rolls 11 which direct the copy paper 4 into engagement with the press roll 14 which together with the transfer roll 15 and a plurality of narrow insulating belts 16 movably supported between the rolls 14 and 15 forms a transfer assembly 17 for contacting the copy paper with the photosensitive drum 13. After uniform charging of the photoconductive surface of the photosensitive drum 13 by a corona charger Ch and exposure thereof at an exposure station E to form an electrostatic latent image thereon, the electrostatic image is transferred onto the sheet of copy paper 4 due to the action of the transfer roll 15 after which the sheet of copy paper is detached from the surface of the drum 13 by separator elements 18 including a separator claw 18*a* pivotally mounted on a shaft 18*b* and guided into engagement with rolls 19 which preferably have the same construction as the forwarding rolls 5, are also electrically grounded, and forward the copy paper to a development stage not shown. As the drum 13 continues to rotate, it is brought past an erasing station e for removal of residual charge remaining in the photoconductive outer layer thereof, then past a cleaning means 20 which removes any thin oxidation layer which may be formed on the surface of the photosensitive drum 13 or dust particles, etc. caused to adhere thereto by electrostatic attraction, and which comprises a roll of soft porous paper 20*a* which is driven round a sponge roller 20*b* in contact with and in a direction counter to that of the photosensitive drum surface, after which the drum 13 again passes the charging station and exposure station E and the abovedescribed process is repeated in order to obtain the next copy.

To avoid undue wear of the surface of the drum 13 the separator elements 18 are suitably constituted by one or more chrome-plated phosphor bronze plates which contact the drum surface and at the outer edge or edges of which there are fixed plastic scraper elements.

As is clear from the above description, the present invention provides a means for effective prevention of smudging or blanks in photocopies obtained in an electrostatic photocopying machine, but requires no special materials and only very simple installation work to achieve this. It was found for example that when an electrostatic photocopying machine in which the rolls 11 and 19 were made of dielectric material was employed for continuous production of photocopies, smudging or blanks were apparent in photocopies after production of about 500 copies. In contrast to this, when the rolls 5, 11, and 19 were made of material selected in accordance with the invention and were grounded, during employment of the photocopying machine in continuous production, up to 3000 photocopies free of smudging or blanks could be produced.

Referring to FIG. 5, an electrostatic photocopying machine of the latent image transfer type according to the embodiment of FIG. 4 is schematically shown, with like parts being designated by like reference numerals. As earlier described, the copy paper 4 is fed into the transfer assembly 17 through the forwarding rolls 5*a* and 5*b* and guide rolls 11*a* and 11*b* for transferring the latent image formed on the photoconductive surface of the photosensitive drum 13 onto the copy paper 4. The principle of the transfer is disclosed in U.S. Pat. No. 3,824,012, so that reference should be made thereto for details.

It should be noted that the insulating press roll 14 disposed in the transfer assembly 17 need not necessarily be in the configuration of a roll, but may be in the shape of sheet-like guide plate.

Represented by reference character C are electrically conductive members such as the copy paper web cutters 6*a* and 6*b*, metallic guide plates and the like arranged along the transportation path of the copy paper 4 and contacting the insulating dielectric layer formed on the copy paper 4. The transfer roll 15 preferably has a resistance to electrical current not exceeding $10^6\,\Omega$, is electrically grounded, and is manufactured by dipping open-cell foamed urethane in a solution having acrylic acid ester, alcohol, and carbon as principal constituents, then drying the foamed urethane, and then fixing foamed urethane around the periphery of an iron or steel roll, for example, thereby imparting elasticity to the transfer roll 15.

It will be noted that since the function of the guide rolls 11 is to guide copy paper 4 accurately to the junction between the press roll 14 and the photoconductive surface of the photosensitive drum 13, the guide rolls 11 must be close to the drum 13 and are therefore particularly liable to become charged to a potential close to that of the drum 13, for example due to ions from the drum 13, after the photocopying equipment has been functioning continuously for a considerable time.

When the leading edge of a sheet of copy paper 4 is first brought into contact with the photosensitive drum 13, the trailing end portion thereof may still contact conductive elements C in the photocopying machine. In this situation there is constituted an electrical circuit such as shown schematically in FIG. 6, in which the dotted line portions represent additional circuits constituted according to the method of the invention, and solid line portions represent circuits present in a conventional photocopying machine. At the surface of the drum 13 carrying an electrostatic image there is a potential Vs, while the conductive elements are essentially at ground level, ground level being taken to mean potential of the chassis or main body of the photocopying machine. At the leading end portion of the copy paper 4 in contact with the photosensitive drum 13 the dielectric layer constitutes a capacitor Cp, while the portion of the dielectric layer in contact with the conductive elements C at the rear end portion of the copy paper 4 constitutes a capacitor Cp′, and the copy paper photosensitive portion extending between the leading and rear end portions of the copy paper 4 constitutes a resistor Ri. In this situation, i.e., when the copy paper 4 is contacting both the photosensitive drum 13 and the conductive elements C, the charge Vs passes through Cp, Ri and Cp′ and thus affects the rear end portion of the copy sheet 4, the capacitor Cp′ being charged with a voltage which is principally dependent on the value of Ri and the value of Vs with respect to ground. Because of this transfer of the charge Vs, or at least a component thereof, the rear end portion of the copy paper 4 is charged with voltage which has a polarity opposite to that with which the copy paper 4 is subsequently charged in order to produce an electrostatic image thereon, and so acts to partially or completely cancel charges representative of the content of a document, for example, whereby, subsequent to development, the copy of the image on the copy paper has incomplete portions. Theoretically this problem can be avoided by employing only dielectric materials in construction of the photocopying machine, but such a solution is not currently practicable.

This problem is avoided according to the invention by providing electrically conductive means which is located along the path of copy paper 4 shortly before the press roll 14, is contacted by the rear, conductive layer of the copy paper 4, and is grounded, and so acts to bring the potential of the copy paper conductive layer to substantially the same level as that of the conductive elements C. In this embodiment of the invention, such conductive means are constituted by the guide rolls 11, material for the construction of which is selected in the same manner as the material for the forwarding rolls 5*a* and 5*b*, and which are grounded as indicated by the dotted line portion of FIG. 5. In this case, referring to FIG. 6, since resistor Ri is grounded, when the copy paper 4 contacts the press roll 14 and photosensitive drum 13, no charge is produced between capacitor Cp′ and resistor Ri, and cancellation of a charge corresponding to electrostatic image elements transferred onto the copy paper 4 is therefore prevented and a copy of improved quality is obtained.

Since the resistance of the conductive layer of the copy paper 4 is very low, although the forwarding rolls 5*a* and 5*b* are much more remote from the drum 13 than the guide rolls 11, being grounded and made of conductive material, the forwarding rolls 5*a* and 5*b* act to keep the potential of the copy paper conductive layer at the same level as the conductive elements C during the initial part of the travel of copy paper 4 through the photocopying machine, as well as preventing build-up of charges due to friction or pressure.

As is seen from the above description, according to the present invention, smudging or soiling of a copied image is prevented by grounding the electrically conductive layer on the back of the copy paper through a conductive member, such as the conductive roll 11*a*, prior to arrival of the copy paper 4 at the electrically conductive grounding member 15 with the copy paper 4 contacting the photoconductive layer of the photoreceptor, by which arrangement, charge injection is advantageously prevented even when the copy paper 4 contacts other electrically conductive members such as the cutter blades 6*a* and 6*b*, thus copied images of high quality being obtained.

In a second arrangement for preventing the second electrostatic soiling, all members contacting the copy paper and disposed along the path of the copy paper up to the insulating press roll 14 are treated so as to be electrically insulating except for the forwarding rolls 5*a* and 5*b*. In other words, the above described image smudging prevention device is disposed around the transportation path of the copy paper, in which device, in the vicinity of the members that will form, on the surface of the copy paper through contact of such members with the copy paper, the electrostatic soiling giving rise to the copied image smudging, electrically insulating guide members are disposed for preventing the former members from contacting the surface of the copy paper, while the remaining contact members other than the above are all treated so as to be electrically insulating, whereby the charge build-up which results in the copied image smudging is eliminated, since the copy paper itself remains in an electrically floating condition, even when the leading edge of the copy paper is held between the insulating press roll 14 and the photoconductive surface of the drum 13 and a relatively large charge is built up in the conductive layer of the copy paper. One of the most important members which forms, on the surface of the copy paper, the electrostatic soiling resulting in the copied image smudging due to contact with the copy paper surface is the cutter means which is an electrically conductive member for cutting the web of copy paper from the paper roll into a required size.

Referring now to FIGS. 7*a*–7*d*, the conductive elements 6 include a stationary cutter 6*a* and a movable cutter 6*b* rotatable in the direction of the arrows which together act to cut off successive lengths of copy paper 4 fed thereto through the forwarding rollers 5*a* and 5*b* rotating in the direction indicated by the arrows, and which cutters are most suitably made of metal and are therefore highly conductive. In a practical photocopying machine there frequently occurs unnecessary contact of the cutters 6 with copy paper 4, since when the leading edge portion of the copy paper 4 comes into engagement with elements such as the press roll 14 of the transfer assembly 17 (FIGS. 4 and 5), the paper 4 may be temporarily stopped and caused to roll up slightly whereby the copy paper 4 is brought into full contact with at least one of the cutters 6*a* or 6*b*. According to one embodiment of the invention, in order to avoid such unnecessary contact resulting in the copied image smudging and facilitate the charge neutralization action of the grounded guide rolls 11 (FIGS. 4 and 5), there is provided an insulating guide roller 7 rotatably mounted on a shaft 7′ which roller 7 is made of a dielectric material and is so located as to maintain the copy paper 4 out of contact with the movable cutter 6*a* or 6*b*. As indicated in FIGS. 7(*a*) through FIG. 7(*d*) the movable cutter 6*a* may be above the copy paper 4 and the fixed cutter 6*b* below or vice-versa, and in either case the guide roller 7 is located between the forwarding rolls 5*a* and 5*b* and the cutters 6 or is located near the side of cutters 6 which is remote from the forwarding rolls 5*a* and 5*b*. More specifically, in FIGS. 7(*a*) and 7(*b*), the stationary cutter 6*a* which is the member causing the copied image smudging to take place is present adjacent the surface of the copy paper along the path of the copy paper 4, and the insulating guide roller 7 is disposed at the left or right hand side of the stationary cutter 6*a*, while in FIGS. 7(*c*) and 7(*d*), the movable cutter 6*b* is present at the side of the copy paper surface for giving rise to the copied image smudging, with the insulating guide roller 7 being disposed at the left or right hand side of the movable cutter 6*b*. In other words, by disposing the insulating guide roller 7 at the side of the copy paper surface as described above, the copy paper surface is advantageously prevented from contacting the cutters 6 due to the presence of the roller 7, even when the copy paper approaches the stationary cutter 6*a* or the movable cutter 6*b* due to the rolling up of the copy paper during its transportation.

It should be noted here that the forwarding rolls 5*a* and 5*b* formed of electrically conductive material are suitably grounded for the prevention of electrification due to static charge build-up.

It should also be noted that the embodiment of FIG. 4 described above is equivalent to the arrangement described with reference to FIG. 7(*b*), and that the transportation rolls 11 composed of electrically conductive material and suitably grounded in FIG. 4 should both be composed of electrically insulating material, while members other than the insulating guide roller 7, such as the roller 9, the loop roller 10, the guide plate 12 and the like are all treated so as to be electrically insulating in the above described embodiment.

By the above arrangement, when the leading edge of the copy paper 4 is brought into contact with the electrostatic latent image formed on the photoconductive surface of the drum 13, i.e., when the same is held or nipped between the insulating press roll 14 and the photoconductive surface of the drum 13, although it has not reached the grounded roll 15 as yet, a large electric field is built up between the copy paper and the electrostatic latent image, with consequent development of a large potential in the conductive layer on the back of the copy paper, in which state, if the copy paper surface contacts the electrically conductive member such as the cutters 6, electrostatic soiling takes place, through electrical conduction between the conductive layer of the copy paper and the electrically conductive member. In the above described embodiments of FIGS. 7(*a*) to 7(*d*), however, such electrostatic soiling can completely be eliminated, since not only does the insulating guide roll 7 prevent the copy paper from contacting the cutter 6*a* or 6*b*, but all other contacting members are advantageously treated so as to be electrically insulating.

As is clear from the above description, the present invention provides a means for effective prevention of smudging or blanks in photocopies obtained in an electrostatic photocopying machine, requiring no special materials with only very simple installation work to achieve this.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed:

1. An electrostatic latent image transfer type copying apparatus which comprises:

a photoconductive member, means for forming an electrostatic latent image on said photoconductive member, image transferring means for conducting transfer material having an insulating dielectric layer coated over an electrically conductive layer into contact with said photoconductive member for transferring said latent image onto said transfer material;

means for transporting the transfer material along a predetermined path to said image transferring means, said transporting means including at least one pair of rollers in nipping relation to each other which are both made of electroconductive material and which are maintained at equal potential, and at least one of said rollers having at least the peripheral layer thereof of elastic electroconductive material, whereby generation of undesired charges on said transfer material due to pressure or friction exerted on said transfer material by said pair of rollers is substantially prevented.

2. In an electrostatic latent image transfer type copying apparatus which includes a photoconductive member, means for forming an electrostatic latent image on said photoconductive member, means for bringing a copying paper having an insulative dielectric layer coated over an electroconductive layer into contact with said photoconductive member for transferring said latent image onto the copying paper, and transporting means for transporting said copying paper along a predetermined path to a developing means through said image transferring means;

the improvement for preventing image contamination of the copying paper by unnecessary charges generated thereon caused by pressure or friction exerted on the copying paper by said transporting means, which comprises;

at least one pair of rollers in said transporting means in nipping relation to one another for transporting the copying paper therebetween, said rollers both being made of electroconductive material and at least one of said rollers being of electroconductive elastic material, and means coupled to said rollers for maintaining said rollers at equal potentials.

3. An electrostatic latent image transfer type copying apparatus as claimed in claim 2, wherein said equipotential maintaining means comprises means for electrically grounding said rollers.

4. An electrostatic latent image transfer type copying apparatus as claimed in claim 2, wherein said equipotential maintaining means comprises means for shortcircuiting said rollers.

5. An electrostatic latent image transfer type copying apparatus as claimed in claim 2, wherein said rollers comprise a metallic roller and an electroconductive resin roller.

6. An electrostatic latent image transfer type copying apparatus as claimed in claim 2, wherein said rollers comprise a metallic roller and an electroconductive rubber roller.

7. An electrostatic latent image transfer type copying apparatus as claimed in claim 2, wherein each of said rollers is made of electroconductive resin material.

8. An electrostatic latent image transfer type copying apparatus as claimed in claim 2, wherein said rollers comprise an electroconductive rubber roller and an electroconductive resin roller.

9. An electrostatic latent image transfer type copying apparatus as claimed in claim 2, wherein each of said rollers is made of electroconductive rubber material.

10. An electrostatic latent image transfer type copying apparatus which comprises;

a copying paper in a roll and having an insulative dielectric layer and an electroconductive layer over which said dielectric layer is coated;

a photoconductive member;

means for bringing said copying paper into contact with the photoconductive member with the dielectric layer contacting the photoconductive member for transferring said latent image onto the copying paper;

means for transporting the copying paper along a predetermined path to a developing means through said image transferring means, said transporting means including at least one pair of feed rollers in nipping relation to one another for transporting the copying paper therebetween, said feed rollers holding a leading end of the copying paper in nipping condition when the paper is not moving in said apparatus and transporting the copying paper when rotated;

said feed rollers both being made of electroconductive material with at least one of said roller being of electroconductive elastic material; and means coupled to said rollers for maintaining said rollers at equal potential, whereby electrostatic contamination on the copying paper due to the compression and frictional charging by said rollers are prevented.

11. An apparatus as claimed in claim 10 wherein said electroconductive layer of the copying paper has a resistivity of about $10^5$ to $10^9\Omega$ and the dielectric layer thereof has a resistivity of greater than $10^{11}\Omega$.

12. An apparatus as claimed in claim 10, wherein said transporting means further includes a plurality of pairs of transporting rollers for transporting the copying paper and each pair of said rollers both being made of electroconductive material with at least one of rollers being of electroconductive elastic material.

13. An electrostatic latent image transfer type copying apparatus as claimed in claim 10, wherein said equipotential maintaining means comprises means for electrically grounding said rollers.

14. An electrostatic latent image transfer type copying apparatus as claimed in claim 10, wherein said equipotential maintaining means comprises means for shortcircuiting said rollers.

15. An electrostatic latent image transfer type copying apparatus as claimed in claim 10, wherein said rollers comprise a metallic roller and an electroconductive resin roller.

16. An electrostatic latent image transfer type copying apparatus as claimed in claim 10, wherein said rollers comprise a metallic roller and an electroconductive rubber roller.

17. An electrostatic latent image transfer type copying apparatus as claimed in claim 10, wherein each of said rollers is made of electroconductive resin material.

18. An electrostatic latent image transfer type copying apparatus as claimed in claim 10, wherein said rollers comprise an electroconductive rubber roller and an electroconductive resin roller.

19. An electrostatic latent image transfer type copying apparatus as claimed in claim 10, wherein each of said rollers is made of electroconductive rubber material.

20. In an electrostatic latent image transfer type copying apparatus which utilizes a paper having an insulative dielectric layer coated over an electroconductive layer for forming an image thereon, and a transporting means for transporting said paper in said apparatus, the improvement for preventing electrostatic contamination of the paper by unnecessary charges generated thereon which is caused by pressure exerted on the paper by a transporting means, which comprises;

at least one pair of feed rollers in said transporting means in nipping relation to one another for transporting the paper therebetween, said feed rollers holding the paper in nipping condition when the paper is not moving in the apparatus and transporting the paper when they are rotated, said feed rollers both being made of electroconductive material with at least one of said roller being made of an electroconductive elastic, and means for maintaining both rollers at equal potential.

* * * * *